US011293315B1

(12) United States Patent
Costa et al.

(10) Patent No.: US 11,293,315 B1
(45) Date of Patent: Apr. 5, 2022

(54) AIR-OIL SEPARATOR DRAIN VALVE AND RELATED METHOD OF USE

(71) Applicant: Sogefi Air & Cooling USA, Inc., Rochester Hills, MI (US)

(72) Inventors: Anderson Costa, Rochester Hills, MI (US); Adilson Lima, Shelby Township, MI (US); Steven Dara, Rochester Hills, MI (US)

(73) Assignee: Sogefi Air & Cooling USA, Inc., Rochester Hills, MI (US)

( * ) Notice: Subject to any disclaimer, the term of this patent is extended or adjusted under 35 U.S.C. 154(b) by 0 days.

(21) Appl. No.: 17/230,758

(22) Filed: Apr. 14, 2021

Related U.S. Application Data

(60) Provisional application No. 63/132,790, filed on Dec. 31, 2020.

(51) Int. Cl.
*F01M 13/04* (2006.01)
*F02M 25/06* (2016.01)
*F01M 11/04* (2006.01)

(52) U.S. Cl.
CPC .... *F01M 13/0416* (2013.01); *F01M 11/0458* (2013.01); *F01M 13/04* (2013.01); *F02M 25/06* (2013.01); *F01M 2013/0488* (2013.01)

(58) Field of Classification Search
CPC ..... F01M 13/0416; F01M 2013/0488; F01M 11/0458; F01M 13/04; F01M 13/022; F02M 25/06; F16N 2031/008
See application file for complete search history.

(56) References Cited

U.S. PATENT DOCUMENTS

| | | | | |
|---|---|---|---|---|
| 7,007,682 | B2 | 3/2006 | Takahashi et al. | |
| 8,893,688 | B2 * | 11/2014 | Ruppel | F01M 13/04 123/573 |
| 9,562,449 | B2 | 2/2017 | Gao et al. | |
| 2003/0000508 | A1 * | 1/2003 | Takahashi | F02M 25/06 123/572 |
| 2017/0241309 | A1 * | 8/2017 | Coolens | F01M 11/0458 |

FOREIGN PATENT DOCUMENTS

| | | | |
|---|---|---|---|
| DE | 20217601 | U1 | 5/2004 |
| DE | 102006018783 | A1 | 2/2007 |
| DE | 202007011585 | U1 | 11/2007 |
| EP | 2796678 | A1 | 10/2014 |
| FR | 2932843 | | 6/2008 |
| JP | 2007009746 | A | 1/2007 |
| JP | 6289885 | B2 | 3/2018 |
| KR | 101251711 | B1 | 4/2013 |

* cited by examiner

*Primary Examiner* — Syed O Hasan
(74) *Attorney, Agent, or Firm* — Warner Norcross + Judd LLP

(57) ABSTRACT

A drain valve of an air-oil separator configured to separate oil aerosol from blow-by gas of an internal combustion engine is provided. The drain valve includes a floating plate adapted to close or open depending on oil flow and pressure relative to a drainpipe, and a plug that maintains the floating plate in the drainpipe and provides a flow path for oil in the drainpipe. The plug can serve a secondary function and form part of a seal recess that receives an annular seal member, such as an o-ring, to form a liquid tight seal around the drainpipe when coupled to another engine component to allow transfer of oil through the drainpipe. A related method of use is provided.

20 Claims, 5 Drawing Sheets

AIR-OIL SEPARATOR DRAIN VALVE AND RELATED METHOD OF USE

BACKGROUND OF THE INVENTION

The present invention relates to air-oil separators, and more particularly to a drain valve for an air-oil separator for use with an internal combustion engine.

In most internal combustion engines, combustion gas from combustion chambers frequently enter the engine crankcase. This combustion gas is referred to as blow-by gas, or just as blow-by. To avoid pressure build up in the crankcase, blow-by gas is evacuated from the engine via crankcase ventilation. To satisfy emission standards, blow-by gas cannot be blown into the atmosphere. Instead, it must be vented to the engine's air intake system after the air cleaner. This type of venting system is referred to as a closed crankcase ventilation (CCV) system.

In internal combustion engines, oil mixed with the blow-by gas in aerosol form can produce oily deposits on the intake components. Where the engine is turbocharged, the oil can damage the turbochargers. The oil also can damage air coolers where present. To address and remove the oil from the blow by-gas, an air-oil separator is frequently used, particularly in CCV systems. Most separators separate the oil aerosol in the blow-by gas with a collision plate or deflector, and then supply the gas from which the oil aerosol is separated to an intake. After the separator removes the oil and other contaminants from the blow-by gas, it typically returns the oil to the engine via a gravity drainpipe.

An issue with some separators occurs when there is a pressure difference between the interior of the engine and an interior of the separator, particularly when the separator interior experiences an increase in vacuum from the intake. When this occurs, the oil can flow back from the interior of the engine into the separator interior. In some cases, the engine-drawn oil can be blown into the intake by entrainment in the blow-by gas. To address this issue, some separators include a check valve associated with the drainpipe. The check valve can include a ball that floats in a passageway to open and close based on pressures in the separator and/or the engine, to prevent oil backflow from the engine to the separator via the drainpipe. The ball also can open the valve under the weight of enough accumulated oil to drain the separated oil from the separator. Although this type of check valve works, it can sometimes fail when the ball becomes laden with contaminants from the oil, in which case it might not be movable, and might not be able to achieve an open state. It also can present issues where the ball becomes too laden with oil, the opening and closing operations can become unstable.

Accordingly, there remains room for improvement in the field of drain valves used in connection with air-oil separators.

SUMMARY OF THE INVENTION

A drain valve of an air-oil separator configured to separate oil aerosol from blow-by gas of an internal combustion engine is provided. The drain valve can include a floating plate configured to close or open depending on oil flow and pressure relative to a drainpipe, and a plug that maintains the floating plate in the drainpipe and provides a flow path for oils in the drainpipe. The plug can serve a secondary function and can form part of a seal recess that receives an annular seal member, to form a liquid tight seal around the drainpipe.

In one embodiment, the plug can include a longitudinal axis and an outer plug wall extending upward from a lower plug wall. The outer plug wall can extend along a drainpipe exterior. The outer plug wall can include an outer plug wall upper end that can establish at least a portion of a seal recess.

In another embodiment, the drain valve can include the drainpipe with a shoulder spaced from the outer plug wall, and in particular, its upper end, a distance so as to form a seal recess bounded by the outer plug wall, the drainpipe exterior and the shoulder. That seal recess can be an annular recess that circumferentiates the drainpipe.

In still another embodiment, an annular seal can be disposed in the annular recess forms a liquid tight seal around the drain. The annular seal can be a circular shaped o-ring, optionally constructed from an elastomeric material.

In yet another embodiment, the plug can include multiple fingers joined with the plug. The fingers can extend upward along a drainpipe interior. Each finger can include a plate engagement surface at an upper end of each finger. Each finger can be separated from adjacent fingers at the respective upper ends by at least one flow path that provides a selective flow of oil therein, depending on whether the floating plate is in an open mode or a closed mode.

In even another embodiment, the floating plate is arranged for placement above the upper end of each of the fingers. The floating plate can include an outer plate perimeter, and as mentioned above, can be operable in an open mode to allow the selective flow of oil through the flow path and past the outer plate perimeter. The floating plate also can be operable in a closed mode to impair the selective flow of oil through the flow path and past the outer plate perimeter. As used herein, impair can include and mean restrict, slow, inhibit, prevent and/or block fully, entirely, and/or partially.

In yet another embodiment, the drainpipe can define a bore bounded by a constrictor plate defining a drain opening. The floating plate can float in the bore, between the constrictor plate and the fingers. The floating plate can engage either, depending on the direction of flow or the pressures of oil in the drainpipe and in adjacent conduits or components.

In a further embodiment, a method is provided. The method can include installing a plug on a drainpipe so that an outer plug wall extends along a drainpipe exterior, the outer plug wall cooperating with a shoulder to form a seal recess around the drainpipe within which an annular seal is disposed and configured to form a liquid tight seal around the drainpipe. The plug can restrain movement of a floating plate in a drainpipe interior above multiple fingers. The floating plate can be operable in an open mode to allow the selective flow of oil through the flow path, and in a closed mode to impair the selective flow of oil through the flow path.

In still a further embodiment, the method can include placing the plug in the drainpipe so that multiple fingers of the plug extend upward along a drainpipe interior. The fingers can be separated from one another by at least one flow path configured to allow a selective flow of oil around the fingers and past the floating plate.

The current embodiments provide an air-oil separator drain valve and method of use that previously have been unachievable. Where the plug includes a floating valve that floats between fingers of the plug and the constrictor plate, that valve facilitates efficient and stable drainage of oil from the separator. The drain valve has a simple construction yet can still suppress a backflow of oil from the interior of the engine into the separator through the drainpipe. Accordingly, it is possible to prevent the oil from being pulled into an intake of the engine. Further, where the plug of the drain valve forms at least a portion of a seal recess for a seal about the drainpipe, no extra molding, machining or parts are needed to form that seal recess. That seal recess also can be located and sized to receive and allow some movement of the annular seal to enhance the sealing capabilities around the drainpipe and impair leakage of oil from the separator to the environment.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and are being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

Figure 1:
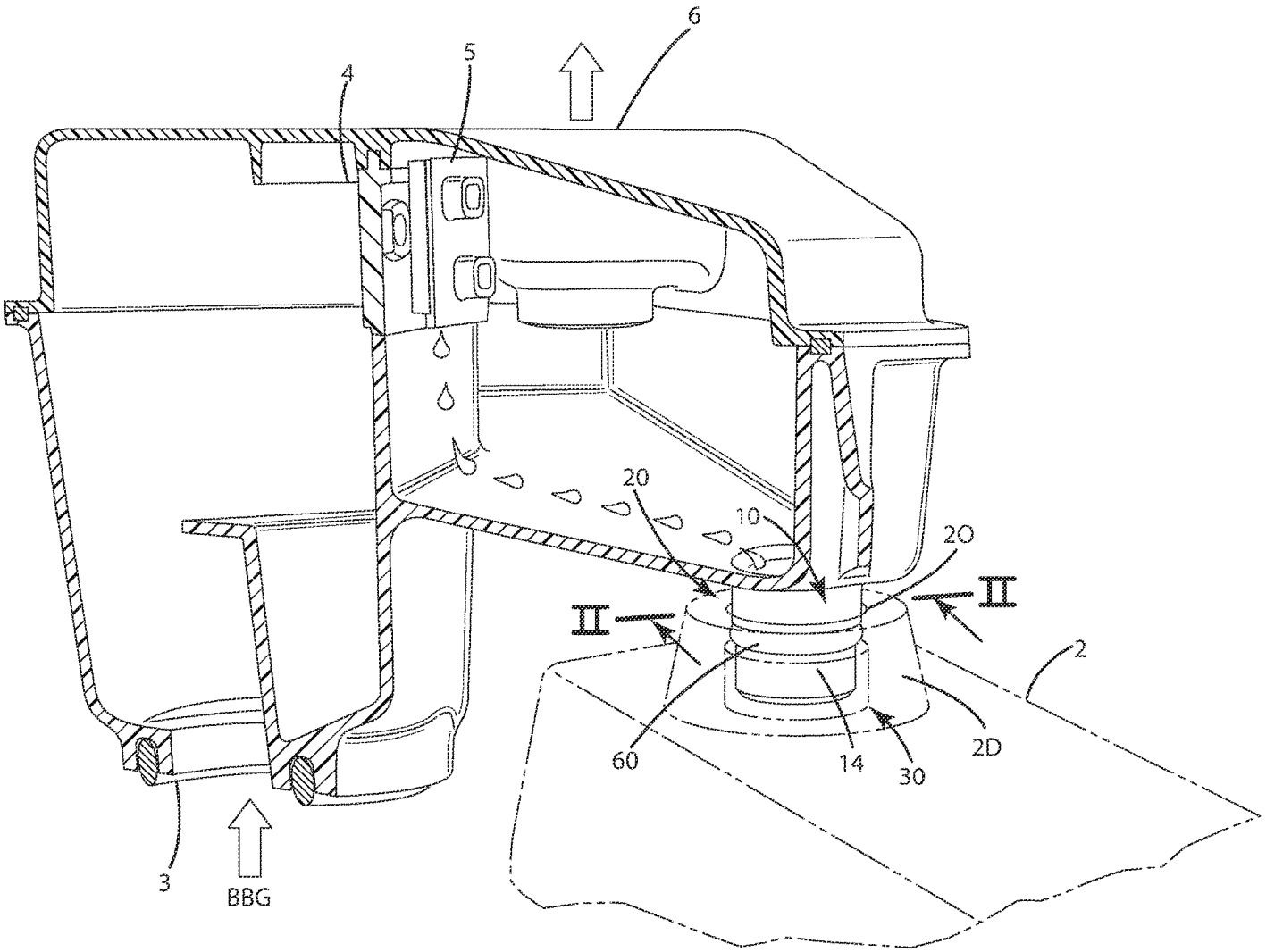
FIG. 1 is a perspective view of an air-oil separator including a drain valve of a current embodiment.

A current embodiment of the air-oil separator drain valve is shown in FIGS. 1-6 and generally designated 10. The drain valve 10 is shown installed in an air-oil separator 1. This air-oil separator 1 is disposed, for example, adjacent to a head cover mounted to a cylinder head of an internal combustion engine, such as a gasoline, diesel, propane engine. The separator 1 includes a blow-by gas inlet 3 into which a blow-by gas BBG is introduced from the engine, for example, from the crankcase. The separator 1 can include a separator portion 4 including an oil impactor assembly 5 tuned to the application in which an oil aerosol can be separated from the blow-by gas in the separator. The separator can further include an outlet 6 to transfer the gas from which the oil aerosol was separated to an intake of the engine. The system can include a drainpipe 10 to discharge the separated oil, typically in liquid form, from the separator portion and separator in general. A drain valve 20 of a current embodiment is associated with the drainpipe 10 and shown in FIGS. 2-6.

Figure 2:
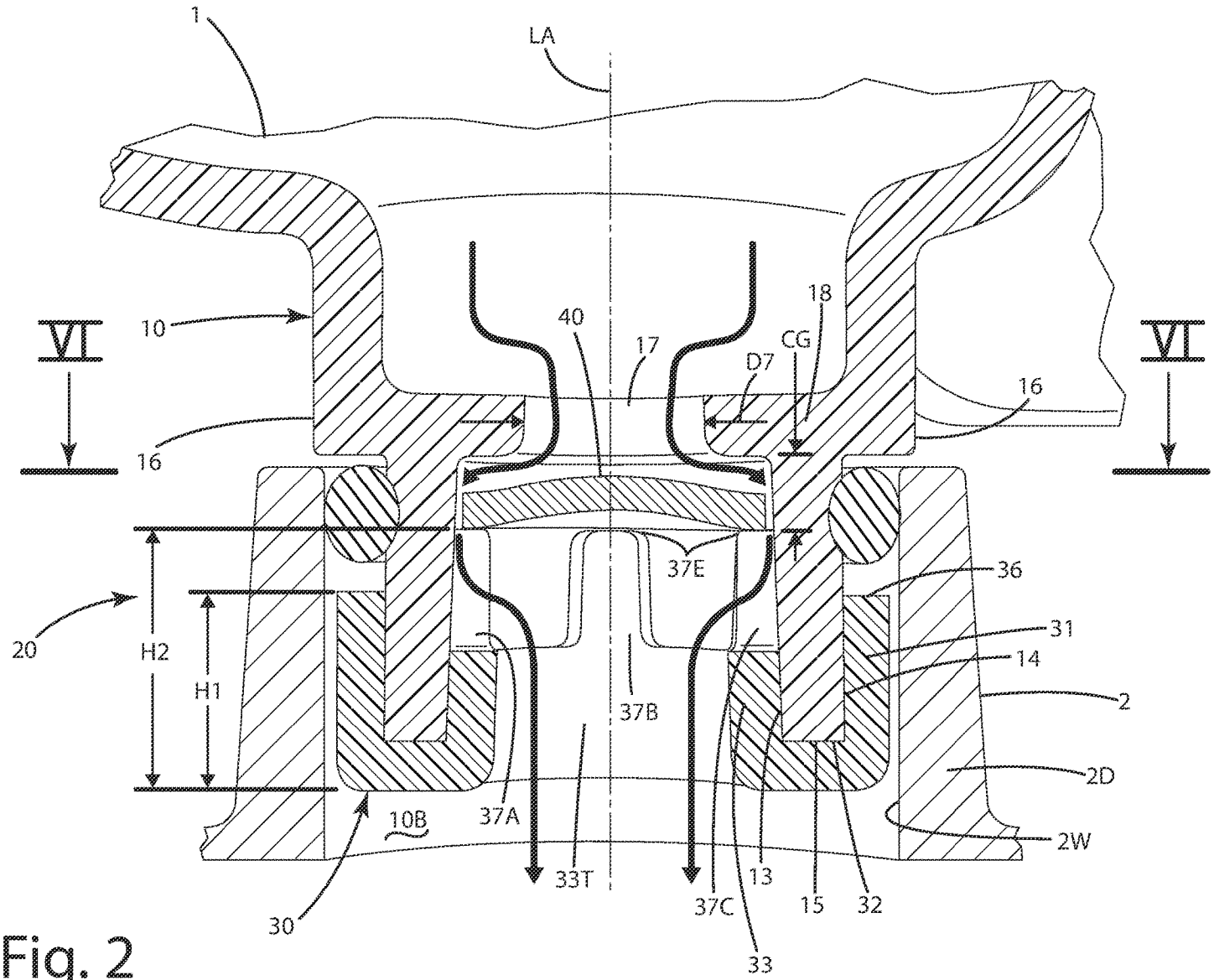
FIG. 2 is a side section view of the drain valve associated with an engine component in a liquid tight sealed manner, with a floating plate in an open mode to allow oil flow past the plate and plug taken along line II-II of FIG. 1.

Generally, the drainpipe 10 and drain valve 20 can selectively control the drainage oil from the separator to the engine component 2 of an engine, and prevent return of oil from the component to the separator, to prevent introduction of that oil into the intake under negative pressure, which is produced by the intake, through the outlet 6. The engine component 2 can be a head cover, an engine block port, an oil pan fitting, an oil filler neck or other inputs to the engine. As shown in FIGS. 1 and 2, the engine component 2 can include a neck or tube 2D defining an opening 2O. This opening can be bounded by an interior surface, which can be an interior wall 2W having a diameter and in the form of a cylinder. Of course, other shapes can be used for this neck or tube depending on the application. The drainpipe 10 as shown in FIG. 2 can include a drainpipe interior 13 and the drainpipe exterior 14. The drainpipe also can include a drainpipe shoulder 16, which can extend outward from the drainpipe exterior, or optionally can be a shoulder of some sort extending from another component of the separator 1. The shoulder as shown is integral with the drainpipe but alternatively can be a separate part joined or placed adjacent the drainpipe. The shoulder can transition to the exterior 14, and can be of a larger diameter or dimension than that of the drainpipe so that it projects outward from the drainpipe exterior.

Figure 3:
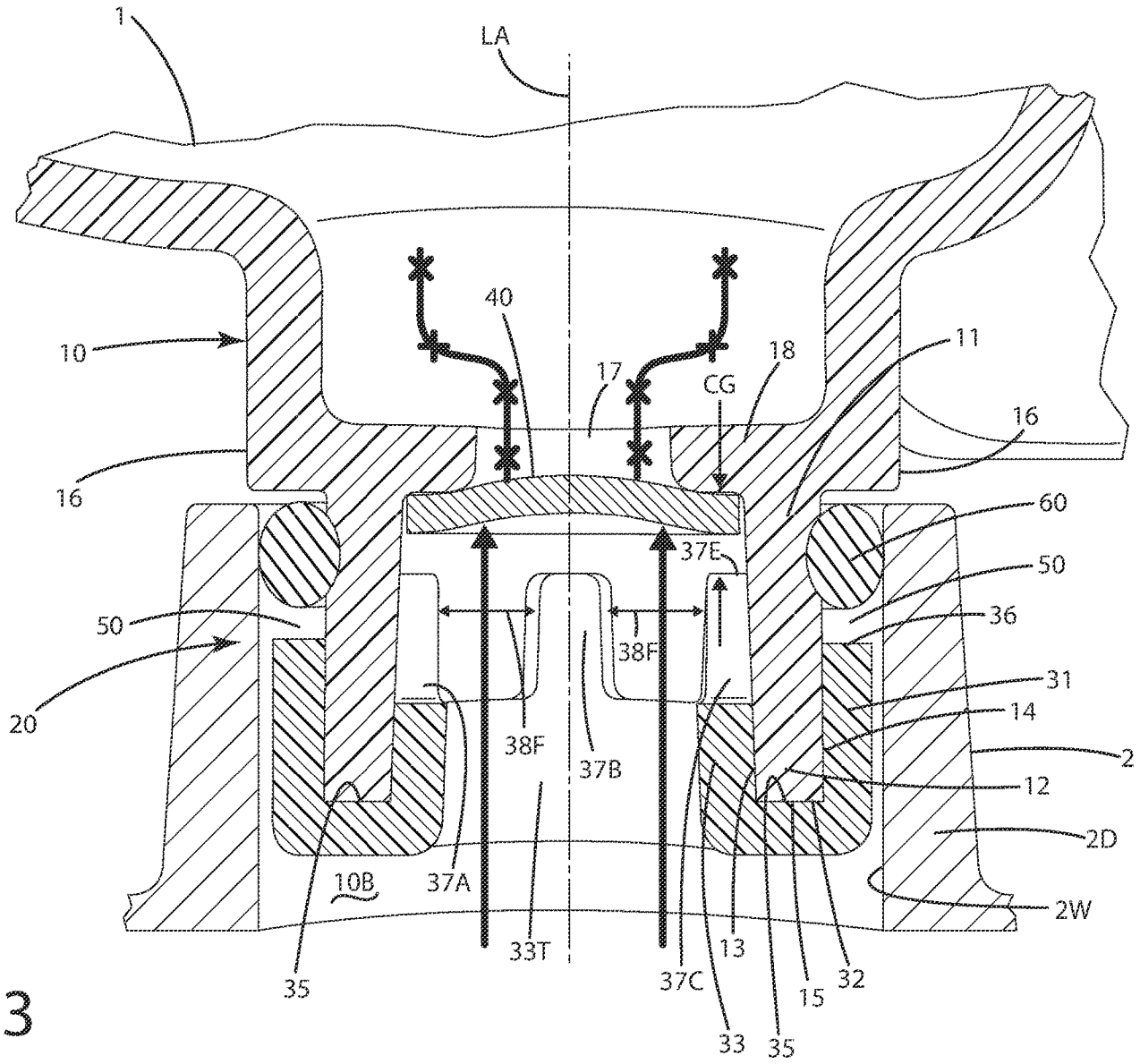
FIG. 3 is a side section perspective close-up view of the drain valve associated with an engine component in a liquid tight sealed manner, with a floating plate in a closed mode to impair oil flow past the plate and plug taken along line II-II of FIG. 1.
Figure 4:
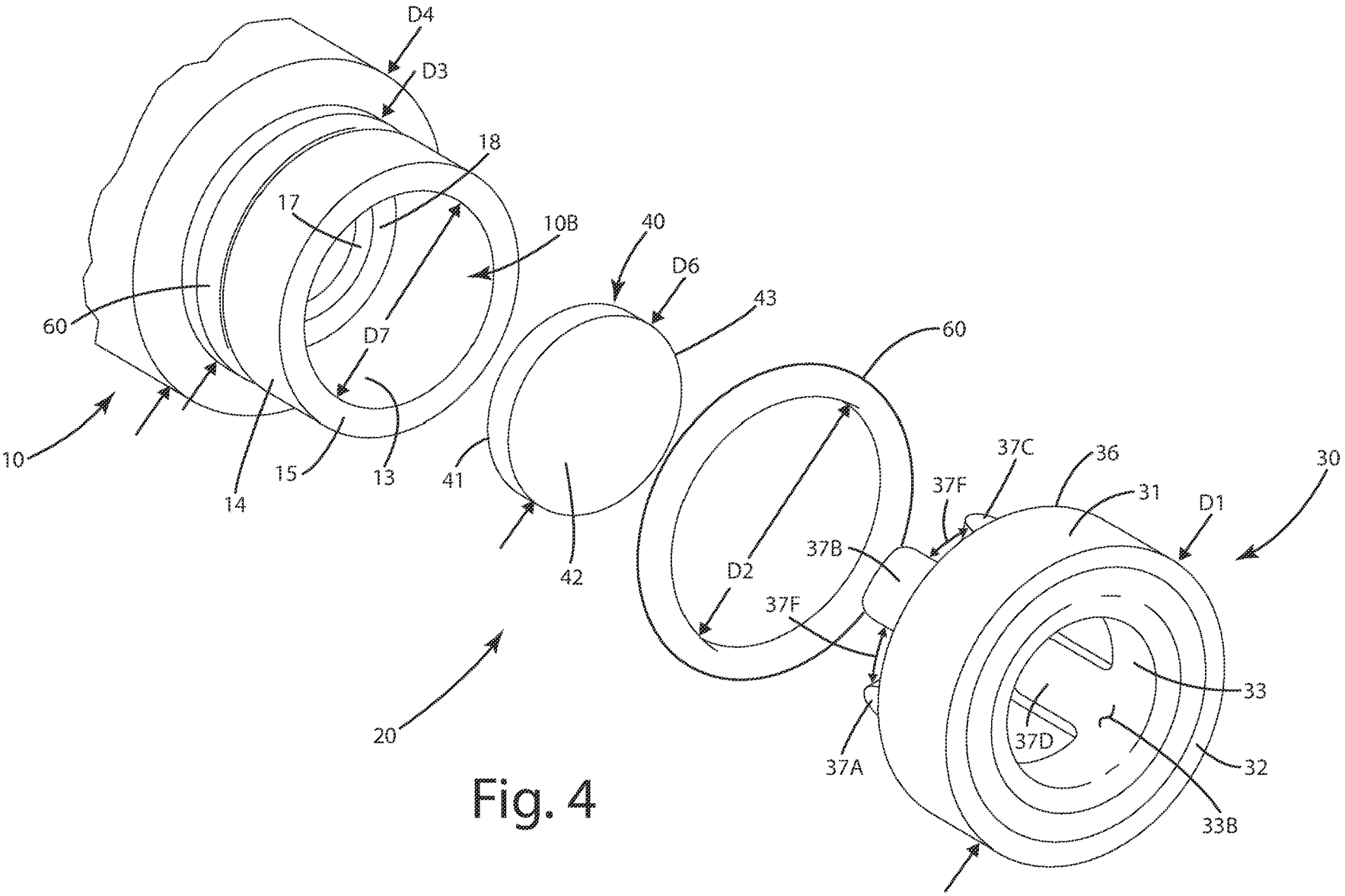
FIG. 4 is an exploded perspective view of the drain valve and an associate drainpipe.

The drainpipe can define a bore 10B that extends between an upper drainpipe end or first end 11 and a lower drainpipe end or second end 12. The bore can be bounded by the drainpipe interior. The lower drainpipe end 12 can include a lower drainpipe edge 15, which connects the interior 13 and exterior 14 of the drainpipe, and forms the lowermost part of the drainpipe. The upper drainpipe end 11 can include a constrictor plate 18 defining a drain opening 17 having a drain opening dimension, As shown in FIGS. 2-4 the drainpipe 10 and drain valve 20 can include a common longitudinal axis LA, which also can be shared with the plug 30 and floating plate 40. The upper drainpipe end 11 can include a constrictor plate 18 that projects inward toward the longitudinal axis LA. That constrictor plate 18 can define a drain opening 17 having a drain opening dimension D1. This opening optionally can be of a circular or round shape, so the dimension can be a diameter. In other applications, the opening shape and size can vary. The diameter can be selected based on the application, oil flow, drainage characteristics and other parameters. This opening can open upward directly to the chamber above the drainpipe defined by the separator 1. The opening also can open downwardly to the bore 10B of the drainpipe, and flow through the opening can be controlled by the floating plate 40 as described below.

Figure 5:
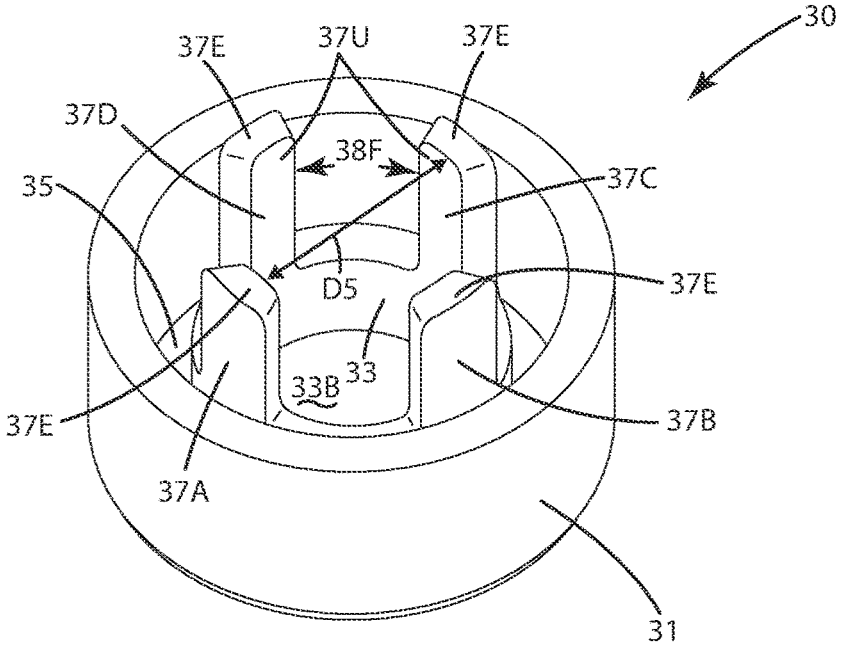
FIG. 5 is a perspective view of the drain plug.

As shown in FIGS. 2, 4 and 5, the drain valve 20 can include the plug 30. This plug can be joined with the drainpipe and can maintain the floating valve 40 in the drainpipe and limit its movement within the bore. The plug can simultaneously function to form part of a seal recess 50 within which a seal 60 is disposed to provide a liquid tight seal between the drainpipe 10 and the neck or tube 2D of the engine component 2. The plug 30 can include an outer plug wall 31 extending upward from a lower plug wall 32. When installed on the drainpipe, the lower plug wall 32 can be disposed adjacent the lower drainpipe edge 15, and optionally over that edge. Both the outer plug wall 31 and inner plug wall 33 can extend upward away from the lower drain edge 15. The outer plug wall, inner plug wall and lower plug wall can be connected and can form a channel or groove 35 within which the lower end of the drainpipe can fit. In some cases, the channel can clamp or grip the drainpipe in a friction fit to hold the plug in place. Optionally, an adhesive or cement can be applied between the channel or plug and the drainpipe to secure it to the drainpipe. Further optionally, the plug can be welded, melted or fused to the drainpipe.

The outer plug wall 31 can extend upward along the drainpipe exterior 14. The outer plug wall can include an outer plug wall upper end. This upper end can include an upper edge 36. The upper end of the outer wall and/or the upper edge generally can establish at least a portion of a seal recess 50 which is constructed to retain a seal element 60 in relation to the drainpipe, generally forming a liquid tight seal between the drainpipe and the interior surface of the wall 2W of the neck or tube 2D so that oil from the neck or the drainpipe does not leak to the environment, and so that the separator can sealingly engage the engine component 2.

The upper edge 36 can be disposed adjacent the drainpipe exterior 14 and distal from the drainpipe shoulder 16. These components, the upper edge, the drainpipe exterior and the drainpipe shoulder can cooperate to form the complete seal recess 50. This seal recess can be an annular recess that circumferentiates the longitudinal axis LA as shown. Optionally, in other applications, the recess can be a sectioned recess that extends in separated segments and can be filled with an appropriate set of sealing elements. As shown, the annular seal 60 is disposed in the annular recess and sealingly engages the drainpipe exterior to form a liquid tight seal about the drainpipe exterior.

Optionally, the annular seal 60 can be a circular shaped o-ring constructed from an elastomeric material, such as rubber, silicone, polymers or other materials. The annular seal 60 can have a diameter D2, and the plug can include a diameter D1 taken to the outer plug wall. The drainpipe exterior can have a diameter D3, and the shoulder can have another diameter D4. The diameter D3 can be less than or equal to the inner diameter D2 of the seal. The diameters D1 and D4 can be greater than D3 of the pipe and D2 of the seal to trap the seal 60 above the outer plug wall, which optionally can be in the form of a cylindrical wall as shown, within the seal recess 50.

The plug 30 can include an inner plug wall 33, which again can extend upward from the lower plug wall 32. This inner plug wall can include a tubular portion 33T that extends along the interior drainpipe wall 13. The inner plug wall 33 can define a bore 33B. The inner plug wall can include multiple fingers 37A-37D. The fingers can extend upward along the drainpipe interior 13 when the plug is installed relative thereto. Each of the fingers can include a plate engagement surface 37E at an upper end 37U of each finger, which upper end can be distal from the tube portion 33T. The fingers can be separated from one another at the respective upper ends by one or more spaces or gaps 38F. These gaps can correspond to respective flow paths between and among the fingers that facilitate and allow selective flow of oil therein and/or between the fingers. When travelling along these flow paths 38F, the oil travels along or between the fingers and past the engagement surfaces 37E, in up or down directions within the drainpipe and valve as explained below.

As shown in FIG. 2, the fingers 37A-37D can engage or be placed adjacent the drainpipe interior 13. The fingers can extend upward a height H2 from the lower plug wall 32 that is less than the height H1 that the outer plug wall extends up from the lower plug wall. This can provide extra space on the drainpipe exterior so that the seal recess 50 can be formed above the outer plug wall. The fingers and the respective plate engagement surfaces can be distanced from the constrictor plate 18 to form a control space or compartment or gap CG, between the fingers and the constrictor plate 18. The plate 40 can be located below the constrictor plate and the opening. The floating plate 40 can be positioned within the control gap CG and generally trapped but moveable therein by the plug inside the drainpipe interior 13 and the associated drainpipe bore 10B. The floating valve can be moveable toward and away from the constrictor plate 18, and drain opening 17, within the control gap as described below.

The floating plate 40 can be arranged for placement above the upper end of each of the plurality of fingers, and can contact and engage the plate engagement surfaces 37E of one or more or all of those surfaces as described below. The floating plate 40 can be transverse to the longitudinal axis LA, which can pass through the floating plate. Optionally it can be perpendicular to the longitudinal axis and/or orthogonal to it. The floating plate can include an outer plate perimeter 43. This outer plate perimeter can define a maximum dimension, which as shown can be a diameter D6. This diameter can pass through the longitudinal axis LA. This diameter D6 can be less than the diameter D5 between opposing fingers or generally the diameter D5 of the bore. The diameter D6 also can be greater than the diameter D7 of the opening 17 of the constrictor plate 18 of the drainpipe 10. With this difference in diameters of the floating plate and the opening, the floating plate can effectively cover and close the opening when the floating plate and valve in general is in the closed mode.

When in the closed mode shown in FIG. 3, the plate 40 can engage the constrictor plate 18 with the plate upper surface 41, which optionally can directly engage the constrictor plate 18 along the lower surface of the constrictor plate. The plate can be in the upper end of the control gap CG in this mode. Generally, when in the closed mode, the floating plate is distal from the fingers and covers the drain opening. When in the closed mode, the floating plate 40 can impair the flow of oil through one or more of the flow paths 38F and past the outer plate perimeter 43. Typically, the flow paths can be obstructed and/or restricted entirely by way of the fluid communication between those flow paths and the opening 17 being completely or substantially obstructed by the floating plate 40. The flow of oil thus can be selectively impaired and/or prevented from flowing around the perimeter 43 to the opening. The floating valve can enter this closed mode in FIG. 3 when the pressure from the oil in the engine is high enough to push the oil against the plate 40 and against the constrictor plate, and/or when the pressure inside the air-oil separator is negative enough to pull the floating plate 40 against the constrictor plate 18. Generally, the plate can be sucked by the intake negative pressure so that the opening 17 is closed to thereby prevent a backflow of the oil from the engine to the air oil separator 1. The upper surface 41 of the plate can directly engage and/or contact the lower surface of the constrictor plate around the opening 17.

Figure 6:
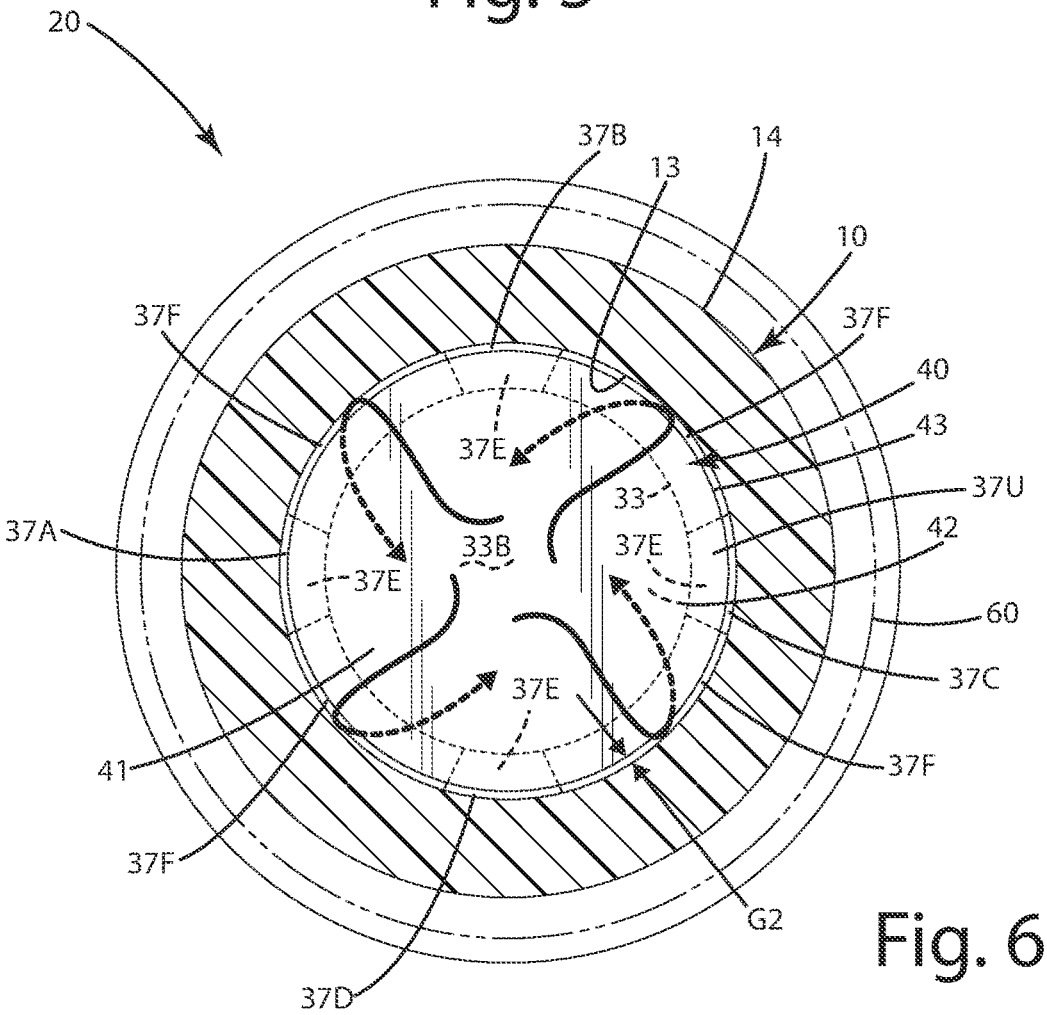
FIG. 6 is a top view of the floating plate disposed above fingers of the plug with oil flowing past a plate perimeter and through flow paths between and among the fingers when the floating plate is in the open mode.

When in the open mode shown in FIG. 2, the plate 40 can be at the lower end of the control gap CG. The floating plate 40 can rest on and/or otherwise engage the plate engagement surface 37E of each of the plurality of fingers in the open mode. When in the open mode, the floating plate can allow the selective flow of oil through the flow paths 38F and past the outer plate perimeter 43 as shown in FIGS. 2 and 6. Optionally, the floating plate 40 can engage one or more upper ends of the fingers partially in the open mode. For example, as shown in FIG. 6, the lower surface 42 of the floating plate can engage the engagement surface 37E of finger 37C, but another portion 37U thereof is not engaged by the plate surface 42. There also can be a gap G2 established between the perimeter 43 and the drainpipe interior 13 of the drainpipe. This can facilitate passage of oil around the perimeter and thus the floating plate 40. Further optionally, although not shown, the perimeter of the plate can be interrupted by one or more recesses about that perimeter, extending inward from the perimeter toward the longitudinal axis. These recesses can be scalloped shaped, polygonal shaped, rounded or other shapes, and can be configured to increase oil flow between the plate and the surrounding wall. The recesses can be offset from the fingers so that the plate does not become bound up via the fingers being trapped in a recess or two.

Generally, when in the open mode, the floating plate is distal from the constrictor plate and drain opening, so that these elements are not covered by it. When in the open mode, the floating plate 40 can allow selective flow of oil through one or more of the flow paths 38F and past the outer plate perimeter 43. Typically, the flow paths can be opened and unobstructed by way of the fluid communication between those flow paths and the opening 17 being opened, with the oil flowing optionally through the gap G2 between the plate and the drainpipe interior. The flow of oil thus can be selectively allowed to flow around the perimeter 43 to the opening. The floating valve can enter this open mode in FIG. 2 when a pressure difference between the interior of the separator and the interior of the engine is small. For example, when the engine is at idle or is stopped, the plate 40 can be pushed down by the weight of the oil so that the opening 17 is effectively opened. The oil can thus flow, optionally via gravity, down over the upper surface 41 of the plate, past the perimeter 43, between the fingers 37, through the paths 37F, and out the bore 33B to the component 2. Optionally, when oil accumulates in the drainpipe 10 above the constrictor plate, the floating plate 40 can be pushed down by a head pressure of the oil so that the oil is drained out the drainpipe as shown in FIGS. 2 and 5. Later, the plate 40 can be pulled by the negative pressure of the intake so that the plate moves in the control gap against the constrictor plate against the opening 17 so that opening is closed.

A method of using the drain valve 10 of the separator 10 can include installing a plug 30 on a drainpipe 10 so that an outer plug wall 31 extends along a drainpipe exterior 14. The outer plug wall can cooperate with a shoulder 16 and optionally the exterior 14 to form a seal recess 50 around the drainpipe 10. An annular seal 60 can be disposed in that recess, and can form a liquid tight seal around the drainpipe, optionally when installed in the tube 2D of the engine component 2. The plug 30 can include the fingers 37A-D that extend upward along the drainpipe interior. The fingers 37A-D can be separated from one another by at least one flow path 37F that can allow a selective flow of oil therein, for example, impaired flow when the plate is in the closed mode, and through flow to drain the separator and pipe when the plate is in the open mode. The plug restrains movement of a floating plate in a drainpipe interior above the fingers in the control gap CG. The floating plate can be operable in an open mode to allow the selective flow of oil through the flow path, and in a closed mode to impair the selective flow of oil through the flow path. As noted above, the floating plate 40 can be positioned to float in a bore of the drainpipe between a constrictor plate and the fingers. The floating plate can rest on a plate engagement surface of each of the plurality of fingers in the open mode. The floating plate can be distal from the plurality of fingers and can cover the drain opening in the closed mode.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to" another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, any combination of X, Y and Z, for example, X, Y, Z; X, Y; X, Z; Y, Z, and/or any other possible combination together or alone of those elements, noting that the same is open ended and can include other elements.

What is claimed is:

1. A drain valve of an air-oil separator configured to separate oil aerosol from blow-by gas of an internal combustion engine, and discharge separated oil from a drainpipe into the engine, while supplying the gas, from which the oil aerosol is separated, to an intake, the drain valve comprising:

a plug including a longitudinal axis and an outer plug wall extending upward from a lower plug wall, the outer plug wall configured to extend upward along a drainpipe exterior, the outer plug wall including an outer plug wall upper end configured to establish at least a portion of a seal recess;

a plurality of fingers joined with the plug and configured to extend upward adjacent a drainpipe interior, each of the plurality of fingers including a plate engagement surface at an upper end of each finger, the plurality of fingers separated from one another at the respective upper ends by at least one flow path configured to allow a selective flow of oil therein; and a floating plate arranged for placement above the upper end of each of the plurality of fingers, the floating plate transverse to the longitudinal axis which passes through the floating plate, the floating plate including an outer plate perimeter, the floating plate operable in an open mode to allow flow of oil through the flow path and past the outer plate perimeter, the floating plate operable in a closed mode to impair flow of oil through the flow path and past the outer plate perimeter, wherein in the open mode, the floating plate engages the plate engagement surface at the upper end of each of the plurality of fingers.

2. The drain valve of claim 1, comprising:

a drainpipe including the drainpipe interior and the drainpipe exterior, the drainpipe including a drainpipe shoulder, wherein the drainpipe shoulder transitions to the drainpipe exterior, wherein the outer plug wall upper end includes an upper edge, wherein the upper edge is disposed adjacent the drainpipe exterior and distal from the drainpipe shoulder, wherein the upper edge, the drainpipe exterior and the drainpipe shoulder form a seal recess.

3. The drain valve of claim 2, wherein the seal recess is an annular recess that circumferentiates the drainpipe, wherein an annular seal is disposed in the annular recess and sealingly engages the drainpipe exterior to form a liquid tight seal about the drainpipe exterior.

4. The drain valve of claim 3, wherein the annular seal is a circular shaped o-ring constructed from an elastomeric material.

5. The drain valve of claim 1, comprising:

a drainpipe defining a bore extending between an upper drainpipe end and a lower drainpipe end, the lower drainpipe end including a lower drainpipe edge, wherein the lower plug wall is disposed adjacent the lower drainpipe edge.

6. The drain valve of claim 5, wherein the lower plug wall engages the lower drainpipe edge, wherein the outer plug wall extends upward away from the lower drain edge, wherein the plurality of fingers extend upward away from the lower drain edge.

7. The drain valve of claim 1, comprising:

a drainpipe defining a bore extending between an upper drainpipe end and a lower drainpipe end, the upper drainpipe end including a constrictor plate defining a drain opening having a drain opening dimension, wherein the floating plate includes a floating plate dimension that passes through the longitudinal axis, wherein the floating plate dimension is greater than the drain opening dimension so that the floating plate covers the drain opening when in the closed mode.

8. The drain valve of claim 7, wherein the floating plate engages the constrictor plate to cover the drain opening in the closed mode.

9. The drain valve of claim 8, wherein the plurality of fingers are distanced from the constrictor plate to form a control gap between the plurality of fingers and the constrictor plate, wherein the floating plate is moveable toward and away from the constrictor plate within the control gap.

10. The drain valve of claim 1, comprising:

a constrictor plate defining a drain opening located above the floating plate, wherein the floating plate rests on the plate engagement surface of each of the plurality of fingers in the open mode, wherein the floating plate is distal from the plurality of fingers and covers the drain opening in the closed mode.

11. A drain valve of an air-oil separator configured to separate oil aerosol from blow-by gas of an internal combustion engine, and discharge separated oil from a drainpipe into the engine, while supplying the gas, from which the oil aerosol is separated, to an intake, the drain valve comprising:

a plug including a longitudinal axis and an outer plug wall extending upward from a lower plug wall, the outer plug wall configured to extend upward along a drainpipe exterior, the outer plug wall configured to establish at least a portion of a seal recess;

a plurality of fingers joined with the plug and configured to extend upward along a drainpipe interior the plurality of fingers separated from one another by at least one flow path configured to allow a flow of oil therein; and a floating plate movably constrained in the drainpipe interior above the plurality of fingers, the floating plate operable in an open mode to allow flow of oil through the flow path, the floating plate operable in a closed mode to impair flow of oil through the flow path.

12. The drain valve of claim 11, comprising:

a drainpipe including the drainpipe interior;

a shoulder spaced from the outer plug wall a distance so as to form a seal recess bounded by the outer plug wall, the drainpipe exterior and the shoulder.

13. The drain valve of claim 12, wherein the seal recess is an annular recess that circumferentiates the longitudinal axis, wherein an annular seal is disposed in the annular recess and is configured to form a liquid tight seal around the drain.

14. The drain valve of claim 13, wherein the annular seal is a circular shaped o-ring.

15. The drain valve of claim 11, comprising:

a drainpipe defining a bore bounded by a constrictor plate defining a drain opening having a drain opening dimension, wherein the floating plate is configured to float in the bore between the constrictor plate and the plurality of fingers.

16. The drain valve of claim 15, wherein the floating plate rests on a plate engagement surface of each of the plurality of fingers in the open mode, wherein the floating plate is distal from the plurality of fingers and covers the drain opening in the closed mode.

17. The drain valve of claim 16, comprising:

a shoulder spaced from the outer plug wall a distance so as to form a seal recess bounded by the outer plug wall, the drainpipe exterior and the shoulder, wherein the seal recess is an annular recess, wherein an annular seal is disposed in the annular recess and is configured to form a liquid tight seal around the drain.

18. The drain valve of claim 11 comprising:

a drainpipe defining a bore bounded by a constrictor plate defining a drain opening having a drain opening dimension;

a shoulder spaced from the outer plug wall a distance so as to form a seal recess bounded by the outer plug wall, the drainpipe exterior and the shoulder, wherein the floating plate engages the constrictor plate to cover the drain opening in the closed mode, wherein the plurality of fingers are distanced from the constrictor plate to form a control gap between the plurality of fingers and the constrictor plate, wherein the floating plate is moveable toward and away from the constrictor plate within the control gap, wherein the seal recess is an annular recess that circumferentiates the longitudinal axis, wherein an o-ring is disposed in the annular recess and is configured to form a liquid tight seal around the drain.

19. A method of using a drain valve of an air-oil separator configured to separate oil aerosol from blow-by gas of an internal combustion engine, and discharge separated oil from a drainpipe into the engine, while supplying the gas, from which the oil aerosol is separated, to an intake, the method comprising:

installing a plug on a drainpipe so that an outer plug wall extends along a drainpipe exterior, the outer plug wall cooperating with a shoulder to form a seal recess around the drainpipe within which an annular seal is disposed and configured to form a liquid tight seal around the drainpipe, wherein the plug includes a plurality of fingers that extend upward along a drainpipe interior, the plurality of fingers separated from one another by at least one flow path configured to allow a selective flow of oil therein, wherein the plug restrains movement of a floating plate in a drainpipe interior above the plurality of fingers, the floating plate operable in an open mode to allow flow of oil through the flow path, the floating plate operable in a closed mode to impair flow of oil through the flow path.

20. The method of claim 17, wherein the floating plate is positioned to float in a bore of the drainpipe between a constrictor plate and the plurality of fingers, wherein the floating plate rests on a plate engagement surface of each of the plurality of fingers in the open mode, wherein the floating plate is distal from the plurality of fingers and covers a drain opening in the closed mode.

* * * * *